United States Patent [19]

Cortese

[11] Patent Number: 4,894,971

[45] Date of Patent: Jan. 23, 1990

[54] BOARD REPAIR FOR CORRECTING DEFECTS IN LUMBER OR THE LIKE

[76] Inventor: Thomas F. Cortese, 3333 Guido St., Oakland, Calif. 94602

[21] Appl. No.: 383,448

[22] Filed: Jul. 24, 1989

[51] Int. Cl.[4] ..... E02D 37/00; E04G 23/00; B27G 1/00

[52] U.S. Cl. ..... 52/514; 29/402.13; 144/2 M; 144/332

[58] Field of Search ..... 29/402.13; 52/514; 144/2 M, 330, 332

[56] References Cited

U.S. PATENT DOCUMENTS

| | | | |
|---|---|---|---|
| 276,499 | 4/1883 | Story | 52/514 |
| 1,976,722 | 10/1934 | Goss et al. | 20/91 |
| 2,217,311 | 10/1940 | Goss | 20/93 |
| 2,263,536 | 11/1941 | Dike | 144/332 |
| 2,536,665 | 1/1951 | Skoog | 156/94 |
| 3,487,530 | 1/1970 | Ely | 29/402.13 |
| 3,999,436 | 6/1975 | Elliott | 52/514 |
| 4,674,255 | 6/1987 | Derome | 52/514 |

FOREIGN PATENT DOCUMENTS

| | | | |
|---|---|---|---|
| 1921055 | 11/1970 | Fed. Rep. of Germany | 144/332 |
| 2517908 | 11/1976 | Fed. Rep. of Germany | 52/514 |

*Primary Examiner*—W. Donald Bray

*Attorney, Agent, or Firm*—Harris Zimmerman; Howard Cohen

[57] ABSTRACT

Boards of lumber or the like which exhibit defects such as knots or knotholes are repaired by cutting a bore through the board at the site of the defect and by filling the bore with a plug of conforming shape. The width of the bore changes at a first location along its axis and undergoes a reverse change at another location in order to interlock the plug with the board. The plug may be formed by filling the bore with hardenable mastic or by fitting conforming pieces of wood or the like into opposite ends of the bore, the pieces being abutted and secured together by adhesive. The interlocking configuration of the bore and plug assures that the plug cannot be ejected from the board.

18 Claims, 2 Drawing Sheets

FIG_1
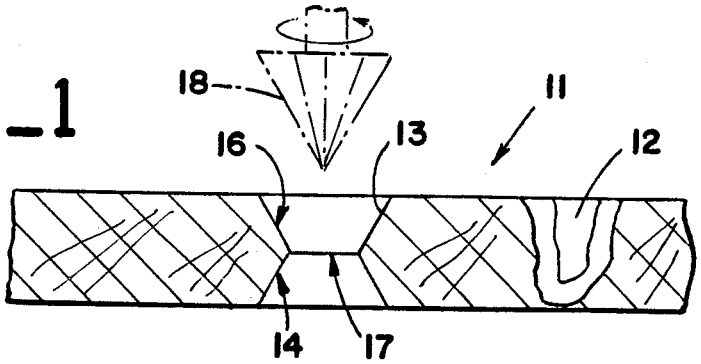
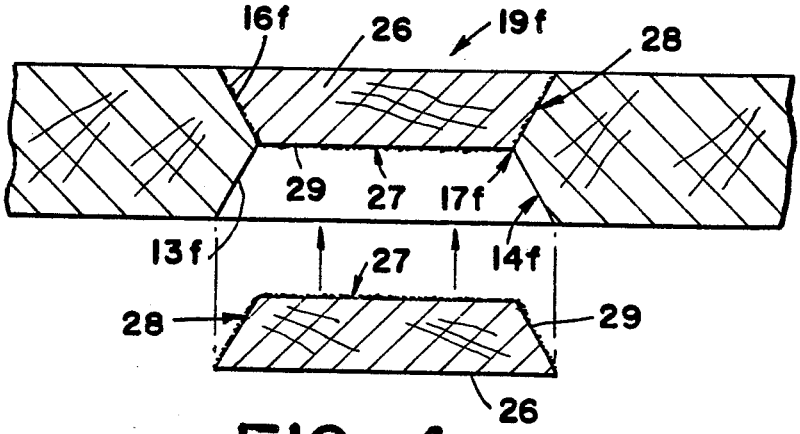
FIG_4
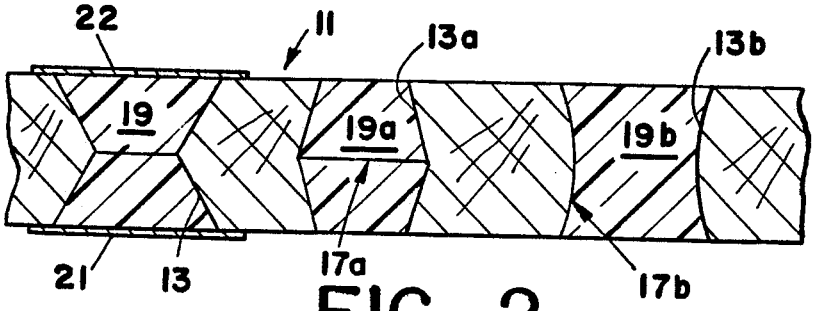
FIG_2
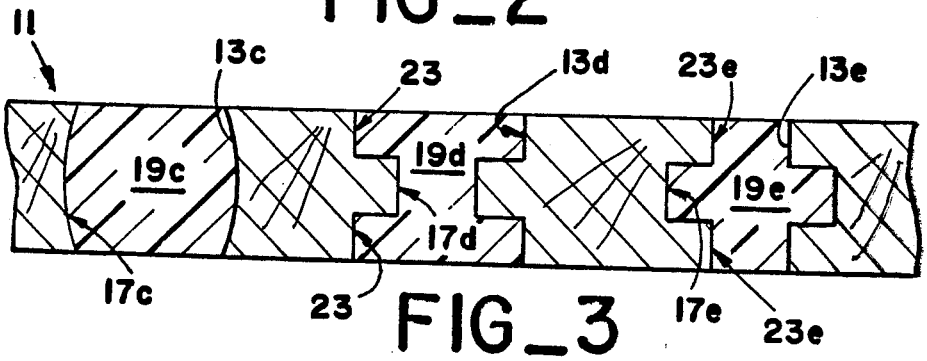
FIG_3

BOARD REPAIR FOR CORRECTING DEFECTS IN LUMBER OR THE LIKE

TECHNICAL FIELD

The invention relates to the correction of defects in lumber or other boards of structural material. More particularly the invention relates to boards in which knotholes or other defects are removed and replaced with filler material and to a method for correcting such defects.

BACKGROUND OF THE INVENTION

Boards of lumber produced at a sawmill or the like may exhibit defects which adversely affect the quality of the material and which may make it unsuitable for intended uses. Knot free boards are desirable for some purposes. Knots make it difficult to prepare a smooth finish on the surface of a board, may bleed pitch and have a tendency to loosen and drop out after a period of time. In other cases where knots are acceptable, there may be loose knots, split knots or knotholes which downgrade the quality of the lumber. Other forms of localized defect can also be present such as decayed areas, pitch pockets, impact damage or excavations made by birds or insects.

Such defects in boards of lumber or the like can be repaired and the quality of the lumber upgraded by cutting a bore through the board to remove the defective region and then filling the resulting opening with a filler material which may be a hardenable mastic or a plug formed of the same wood as the board that is secured in place with adhesive. The techniques heretofore used for repairing defects in this manner do not provide optimum results. The plug of filler material is held in place in the opening in the original wood solely by adhesives and thus the plug can be loosened and ejected by impacts or other forces.

Prior board defect repairs also tend to require complicated installation operations such as the forming of openings in the wood and fabrication of conforming plugs that each have a convoluted shape for resisting twisting of the emplaced plug and for providing a greater area for application of adhesive. One prior process requires the complication of providing threads at the opening in the board and also on the plug so that a threaded engagement, reinforced by adhesive, can be effected. A threaded plug is not inherently locked into the wood and can be worked loose if subjected to sufficient torsional force.

A board repair which is more positively resistant to loss of plugs from openings in the original wood or the like would be highly advantageous.

The present invention is directed to overcoming one or more of the problems discussed above.

SUMMARY OF THE INVENTION

In one aspect of the present invention, a repaired board of lumber or the like has a bore in the original material of the board that extends between opposite surfaces of the board. The bore is at a region where a defect in the board has been removed in the course of cutting the bore and the bore is filled with a plug of filler material. The width of the bore and plug changes at a first location along the length of the bore and undergoes a reversed change another location along the length of the bore thereby interlocking the plug with the board.

In another aspect of the invention, the plug is formed of hardened mastic material. In still another aspect, the plug is formed of blocks of solid material fitted into opposite ends of the bore and adhered together with adhesive.

In a further aspect, the invention provides a method for repairing a defect in a board of lumber or like material. Steps in the method include cutting a bore through the board to remove the defective portion and forming the bore to have a transverse dimension which increases at a first location along the axis of the bore and which decreases at another location along the axis of the bore. A plug is formed in the bore that fills the bore and which has end surfaces that are coplanar with the opposite surfaces of the bore.

The invention enables the correction of localized defects in boards of lumber or other structural material by cutting out the defective area and filling the resulting passage with a plug in a manner which leaves the plug securely interlocked into the original material of the board. The repair does not constitute a weak spot in the board as the plug cannot be dislodged by impact forces or pressures of magnitudes that can be sustained by other portions of the board. The board repair does not require overly complicated operations and, in many of its preferred forms, does not require specialized tools.

The invention may be further understood by reference to the following description of preferred embodiments and by reference to the accompanying drawings.

BRIEF DESCRIPTION OF THE DRAWINGS

FIG. 1 is a section view of a piece of lumber undergoing correction of a localized defect.

FIG. 2 is a section view of another piece of lumber showing a series of defect repairs of different possible configurations.

FIG. 3 is a section view of still another board illustrating additional possible configurations for the repair.

FIG. 4 is a partially exploded section view of a board showing another form of the defect repair.

DETAILED DESCRIPTION OF THE PREFERRED EMBODIMENTS

Figure 5:
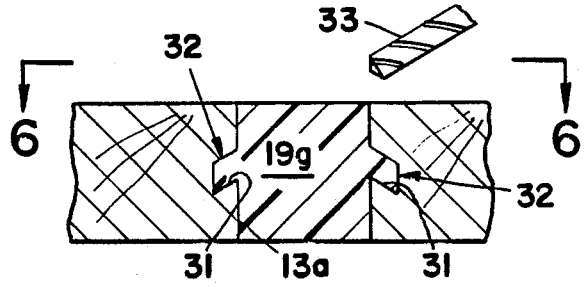
FIG. 5 is another section view of a board illustrating another embodiment of the invention.
Figure 6:
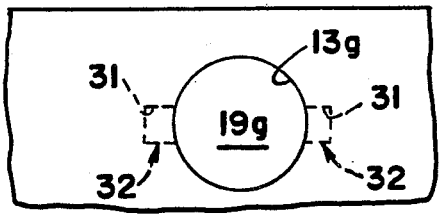
FIG. 6 is a view of the surface of the board region shown in FIG. 5 taken along line 6—6 thereof.

Referring initially to FIG. 1 of the drawings, the invention provides for the upgrading of boards 11 of wood or other similar structural material by providing for removal of localized defects such as knots 12 and restoration of the board in the region of the removed material. It should be recognized that the invention may be used to repair other forms of local defect and may be applied to structural materials other than lumber, fiberboard being one example.

A bore 13 is drilled or otherwise cut through the board 11 at the location of a defect which is to be corrected, the bore being of sufficient diameter to remove any defective wood at the site. The bore 13 is formed to have a non-linear configuration which exhibits a change of diameter or transverse dimension at a first location 14 along the axis of the bore and which undergoes a reversed Change of diameter or transverse dimension at a second location 16 along the axis of the bore.

In the present example, the foregoing condition is met by forming the bore 13 with an intermediate region 17 of predetermined diameter and by causing the diameter of the bore to become progressively greater towards each surface of the board 11 at a uniformly increasing rate. Such a bore can easily be made with standard tools. The bore 13 may, for example, be initially drilled with a drill bit (not shown) having a diameter corresponding to that of the intermediate region 17 after which both end regions may be enlarged with a standard rotary countersink bit 18. Alternately, the countersink bit 18 may be used alone at each side of the board or other types of cutting tool may be used as will be apparent to those skilled in the art of carpentry.

Referring to FIG. 2, the bore 13 is then filled with material which forms a plug 19 that conforms in shape with the bore. The plug 19 may be a filling of mastic which is initially semiliquid but which cures into a hardened state, plastic wood or wood paste being preferred for the purpose as the hardened material then accepts paint or other finishings in the same manner as the other portions of the board. A strip of adhesive coated tape 21 may, if desired, be used to temporarily close the lowermost end of bore 13 during the filling and curing process to provide a smooth end surface on the plug that is co-planar with the adjacent original surface of board 11 and another such strip of tape 22 may be temporarily emplaced over the other end of the bore after the mastic is in place. In the case of finished grades of lumber, the tapes 21 and 22 are abraded away during the final sanding of the board 11 and are removed individually in the case of rough lumber.

Retention of the plug 19 in bore 13 is not dependent on the adhesive properties, if any, of the filler material as the configuration of the bore and plug interlocks the plug with the original material of board 11.

The bore 13 need not have the specific configuration described above in order to provide the desired interlocking. The additional bore **13*a* and plug 13*a* of FIG. 2 is of maximum diameter at the intermediate region 17*a* and becomes progressively narrower at a uniform rate towards each end of the bore and plug. The further additional bore 13*b* and plug 19*b* is of minimum diameter at the intermediate region 17*b*** and becomes progressively broader at a non-uniform rate towards each end of the bore and plug imparting a concave profile to the plug.

The bore **13*c* and plug 19*c* of FIG. 3 has a maximum width at the intermediate region 17*c* and becomes progressively narrower towards each end at a non-uniform rate causing the plug to have a convex profile. Bore 13*d* and plug 19*d* of FIG. 3 has a midsection 17*d* with a uniform first diameter and opposite end regions 23 of a uniform but greater diameter. This configuration is reversed in the bore 13*e* and plug 19*e* of FIG. 3. Bore 13*e* and plug 19*e* have a midsection 17*e* of a uniform first diameter and end regions 23*e* which are of a uniform but smaller diameter. Still other configurations are possible which meet the hereinbefore described conditions for interlocking plugs 19 and boards 11**.

In some instances, the filler material of plug 19 may lack the strength of the original wood. This does not usually cause problems where the bore 13 and plug 19 are relatively small, of the order of one half inch or less for example. In the repair of larger defects, it may sometimes be desirable to form the plug 19 of wood which is preferably similar to the original wood of the board 11. This has the further advantage of providing a repair in which the presence of a plug is less apparent. FIG. 4 depicts the formation of such a repair using a wood plug **19*f***.

The bore **13*f* may have the configuration hereinbefore described with reference to FIG. 1 except insofar as it is typically of greater diameter. Thus, with reference again to FIG. 4, the bore 13*f* has a circular midsection 17*f* of minimum diameter and adjoining opposite end regions 14*f* and 16*f*** which progressively increase in diameter towards the ends of the bore.

Plug **19*f* is formed of two tapered circular blocks 26 of wood each of which has a configuration conforming to that of the regions 14*f* and 16*f* of bore 13*f*. The smaller diameter surfaces 27 and tapered side surfaces 28 of the blocks are coated with adhesive 29 and the blocks are then fitted into opposite ends of bore 13*f*. Hardening of adhesive 29 at the now abutted inner surfaces 27 secures the blocks 26 together to form the plug 19*f* and interlocks the plug with the board 11*f*. Hardening of the adhesive 29 at the sides surfaces 28 of the blocks 26 further secures the plug 19*f*** in place and also prevents rotation of the plug.

The plugs **19*a*, 19*b*, 19*c*, 19*d* and 19*e* of FIGS. 2 and 3 can also be formed of adhered pieces of wood in an essentially similar manner although formation of the particular plugs such as 19*a*, 19*c* and 19*e*** that have inner regions of greater diameter than the end regions tends to be more complicated as a greater number of preformed pieces are needed in such cases.

The regions 14 and 16 where the transverse dimension of the plugs 19 changes need not extend all the way around the periphery the of the plug as in the previously described repairs. For example, with reference to FIG. 5, the bore **13*g* may be basically cylindrical in shape but have outwardly extending connecting passages 31 at one or more limited locations around the periphery of the midsection of the bore. Filling of the bore 13*g* with mastic than forms a plug 19*g* which is interlocked into the board 11*g* by small tab-like projections 32 which extend into the passages 31. Drilling of the passages 31 is more easily accomplished if the passages are angled relative to the rest of the bore and are aligned along axes which extend out through an end of the bore. Such passages can be drilled simply by advancing a drill bit 33 into the end of the bore 13*g*** along such axes.

Figure 7:
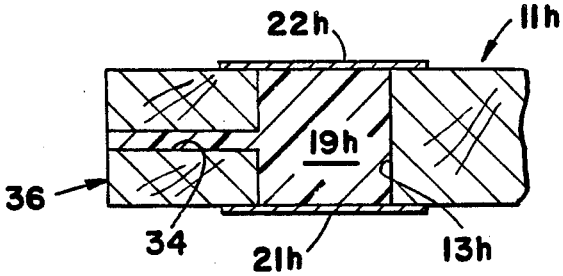
FIG. 7 is a section view of a portion of still another board depicting another embodiment of the defect repair.

In the embodiment of FIG. 7, the bore **13*h* is also essentially of right cylindrical form but has a passage 34 which extends from the midsection, in parallel relationship to the faces of the board 11*h*, to an end or side edge 36 of the board. The plug 19*h* can, if desired, be formed by closing the opposite ends of the bore 13*h* with strips of tape 21*h* and 22*h* in the manner previously described and then injecting mastic into the bore through the passage 34**.

Figure 9:
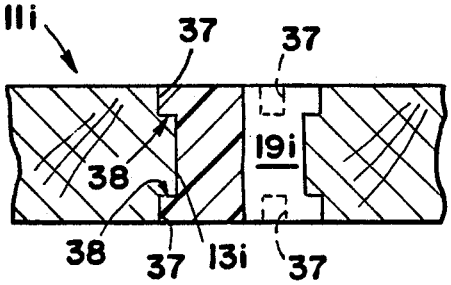
FIG. 9 is a section view taken along line 9—9 of FIG. 8.
Figure 8:
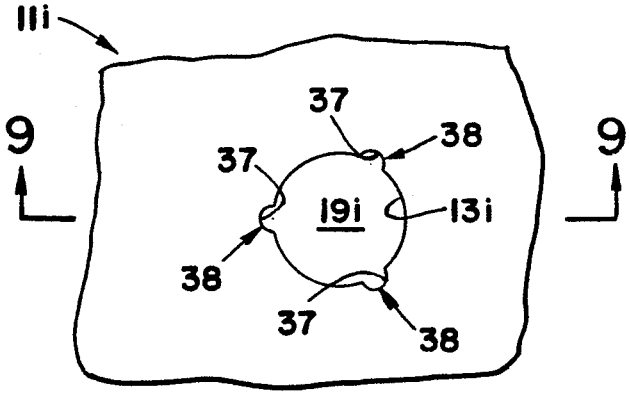
FIG. 8 is a view of the surface of a board repaired in accordance with still another embodiment of the invention.

Referring jointly to FIGS. 8 and 9, a largely cylindrical plug **19*i* may also be interlocked into the board 11*i* by forming notches 37 in the board around the periphery of each end of the otherwise cylindrical bore 13*i*. Filling of the bore 13*i*** with mastic then results in a plug 19*i* having a series of outwardly extending tabs 38 at each end which effect the interlocking action.

Thus many variations and modifications of the invention are possible and it is not intended to limit the invention except as defined in the following claims.

I claim:

1. A repaired board of lumber or similar material having a bore in the original material of the board that extends between opposite surfaces of the board and which is at a region at which a defect in the board has been removed in the course of cutting the bore, said board further having a plug of filler material filling said bore and wherein the width of the bore and plug changes at a first location along the length of the bore and undergoes a reversed change at another location along the length of the bore thereby interlocking said plug with said board.

2. The repaired board of claim 1 wherein an intermediate region of said bore is of smaller diameter than both of the end regions of said bore.

3. The repaired board of claim 2 wherein the diameter of said bore progressively increases at a uniform rate between said intermediate region and each of the end regions of said bore.

4. The repaired board of claim 2 wherein the diameter of said bore becomes continually greater at a progressively increasing rate between said intermediate region and each of the end regions of said bore.

5. The repaired board of claim 2 wherein said intermediate region of said bore has a first uniform diameter and the end regions of said bore have a second uniform diameter that is greater than the diameter of said intermediate region.

6. The repaired board of claim 2 wherein said bore is of uniform diameter except for at least one radially extending enlargement of said bore at each end region thereof, which enlargements extend from limited portions of the peripheries of said end regions, said enlargements being filled with said filler material.

7. The repaired board of claim 1 wherein said board has at least one passage in said original material of said board that extends outward from an intermediate region of said bore within said board, said plug having a projection which extends into said passage.

8. The repaired board of claim 7 wherein said passage extends to an edge of said board.

9. The repaired board of claim 7 wherein said passage is angled relative to the centerline of said bore and extends along an axis which passes through one of the ends of said bore.

10. The repaired board of claim 1 wherein an intermediate region of said bore is of greater diameter than both of the end regions of the bore.

11. The repaired board of claim 10 wherein the diameter of said bore progressively decreases at a uniform rate from said intermediate region thereof towards each of the end regions thereof.

12. The repaired board of claim 10 wherein the diameter of said bore decreases at a progressively greater rate outward in each direction from said intermediate region thereof.

13. The repaired board of claim 10 wherein said intermediate region of said bore has a uniform diameter and the end regions of said bore have a different uniform diameter that is smaller than the diameter of said intermediate region.

14. The repaired board of claim 1 wherein said plug is comprised of hardened mastic material.

15. The repaired board of claim 1 wherein said plug is comprised of pieces of solid material fitted into opposite ends of said bore and adhered together with adhesive.

16. The repaired board of claim 1 wherein the diameter of said bore progressively increases outward from an intermediate region towards each end of said bore, and wherein said plug is comprised of a two pieces of said lumber or similar material each being fitted into an opposite end of said bore and having inner surfaces which abut at said intermediate region of said bore and which are secured together with adhesive.

17. In a method of repairing a defect in a board of lumber or like material, the steps comprising:

cutting a bore through said board at the location of said defect to remove the defective portion thereof, forming said bore to have a transverse dimension which increases at a first location along the axis of the bore and which decreases at another location along the axis of the bore, and forming a plug in said bore which fills said bore and which has end surfaces that are coplanar with the opposite surfaces of said board.

18. The method of claim 17 including the steps of forming said bore with an intermediate region that is of a predetermined diameter and end regions of greater diameter, and forming said plug by fitting conforming pieces of solid material into each of said end regions, abutting said pieces of solid material at said intermediate region and securing said blocks together with adhesive at the abutted surfaces thereof.

* * * * *